United States Patent [19]

Russell

[11] 4,373,305

[45] Feb. 15, 1983

[54] ARCH FORMING STRUCTURE

[75] Inventor: Leslie T. Russell, Halifax, Canada

[73] Assignee: Canadian Patents & Development Limited, Ottawa, Canada

[21] Appl. No.: 232,371

[22] Filed: Feb. 6, 1981

[30] Foreign Application Priority Data

Apr. 10, 1980 [CA] Canada ..... 352073

[51] Int. Cl.[3] ..... E04B 1/32; E04C 3/46

[52] U.S. Cl. ..... 52/86; 52/64; 52/641; 52/645

[58] Field of Search ..... 52/86, 64, 641, 645, 52/71; 249/24, 79, 189, 209; 135/DIG. 1, 4 R

[56] References Cited

U.S. PATENT DOCUMENTS 4,325,207 4/1982 Russell ..... 52/86

*Primary Examiner*—John E. Murtagh
*Assistant Examiner*—Eugene R. Washington
*Attorney, Agent, or Firm*—F. W. Lemon

[57] ABSTRACT

An arch forming structure comprising a flexible arch forming member centerpiece with hinged pairs of struts attached by hinges to each side. The hinged pairs of struts are hingedly attached to a base and collapse inwardly beneath the flexible member. Two tension line lengths are used to snap the hinged pairs of struts from the collapsed condition through dead center to an outwardly sloping position from which further movement is prevented by their central hinge. Two further tension line lengths are jointed to central portions of the hinged pairs of strut members and threaded through eye bolts on the underside of the flexible member and are tensioned by outward movement of the hinged pairs of struts to bend the flexible member into an arch.

4 Claims, 5 Drawing Figures

ARCH FORMING STRUCTURE

Figure 1:
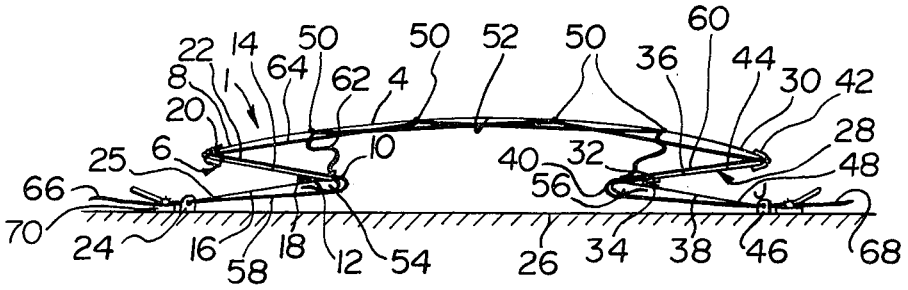

This invention relates to an arch forming structure.

In the applicant's copending U.S. pat. application Ser. No. 21,333, filed Mar. 19, 1979, now U.S. Pat. No. 4,325,207 "An Arch Forming Assembly", L. T. Russell et al, there is described a collapsible arch forming assembly comprising a flexible member and two tension line lengths with one tension line length threaded through even number guides, counted from one end of the flexible member and the other tension line length threaded through the odd number guides. Tensioning the tension line lengths arches the flexible member into the arch and this may be done by a winch assembly or inserting spreader bars at the guides to deflect the free one of the first and second tension line lengths at that position. The spreader bars may be replaced by, for example, mechanical jacks or fluid pressure actuated jacks particularly for such applications as using the arch forming assembly as formwork upon which concrete is poured.

While the arch forming assembly described in the applicant's above mentioned copending U.S. patent application is useful there is a need for an arch forming structure that in the collapsed condition will not exceed the span of the arch formed when the structure is in the erected condition.

According to the present invention there is provided an arch forming structure, comprising:

(a) a flexible member, substantially flat in the collapsed condition and for bending therefrom to form, in the erected condition, the arched portion of the structure, (b) a first pair of hinged strut members at a first end of the flexible member with two adjacent ends of the strut members thereof hinged together and the strut members when folded together at the hinge, in the collapsed condition, extending beneath the flexible member from the first end thereof towards the hinge, the hinge allowing limited pivotal movement between the strut members for them to be unfolded and then restrained against further pivotal movement at the erected position through dead center, (c) a first connecting hinge pivotally connecting a free end of the first pair of hinged strut members to the first end of the flexible member, (d) a first base hinge for pivotally attaching the other free end of the first pair of hinged strut members to a base, (e) a second pair of hinged strut members at a second end of the flexible member, with two adjacent ends of the strut members hinged together and the strut members when folded together at the hinge, in the collapsed condition, extending beneath the flexible member from the second end thereof towards the hinge, the hinge allowing limited pivotal movement between the strut members for them to be unfolded and then restrained against further pivotal movement at an erected position through dead center, (f) a second connecting hinge pivotally connecting a free end of the second pair of hinged strut members to the second end of the flexible member, (g) a second base hinge for pivotally attaching the other free end of the second pair of hinged strut members to a base, (h) a plurality of tension line guide attached to the flexible member at spaced intervals to a side of the flexible member which will define the inside of the arch so that the tension line guides will be spaced therearound, (i) a first tension line deflecting guide attached to the first pair of hinged strut members at a position adjacent the hinge thereof and beneath the strut members thereof when they are folded together in the collapsed condition, (j) a second tension line deflecting guide attached to the second pair of hinged strut members at a position adjacent the hinge thereof and beneath the strut members thereof when they are folded together in the collapsed condition, (k) a first tension line length secured by one end to a portion of the first pair of hinged strut members in the region of the first base hinge and extending along the struts of the first pair of hinged strut members and deflected therefrom by the first tension line deflecting member, with the other end of the first tension line length secured to a portion of the first pair of hinged strut members in the region of the first connecting hinge, (l) a second tension line length secured by one end to a portion of the second pair of hinged strut members in the region of the second base hinge and extending along the strut members of the second pair of hinged strut members and deflected therefrom by the second tension line deflecting member, with the other end of the second tension line length secured to a portion of the second pair of hinged strut members in the region of the second connecting hinge, (m) a third tension line length fastened by one end to the first pair of hinged strut members in the region of the hinge thereof and threaded through odd number tension line guides only, counted from the first pair of hinged strut members, and I. when an even number of tension line guides are provided, secured at the other end to the second pair of strut members in the region of the second connecting hinge, II. when an odd number of tension line guides are provided, secured at the other end to a portion of the second pair of strut members in the region of the hinge thereof, and (n) a fourth tension line length fastened by one end to the first pair of strut members in the region of the first connecting hinge and threaded through even number tension line guides only, counted from the first pair of hinged strut members, and III. when an even number of tension line guides are provided, secured at the other end to the second pair of strut members in the region of the hinge thereof, IV. when an odd number of tension line guides are provided, secured at the other end to the second pair of strut members in the region of the second connecting hinge, whereby, (o) tensioning of the first and second tension line lengths with movement of the first and second pairs of hinged struts from the collapsed condition through dead center to the erected condition will cause the third and fourth tension line lengths to bend the flexible member and form the arched portion of the structure.

Figure 2:
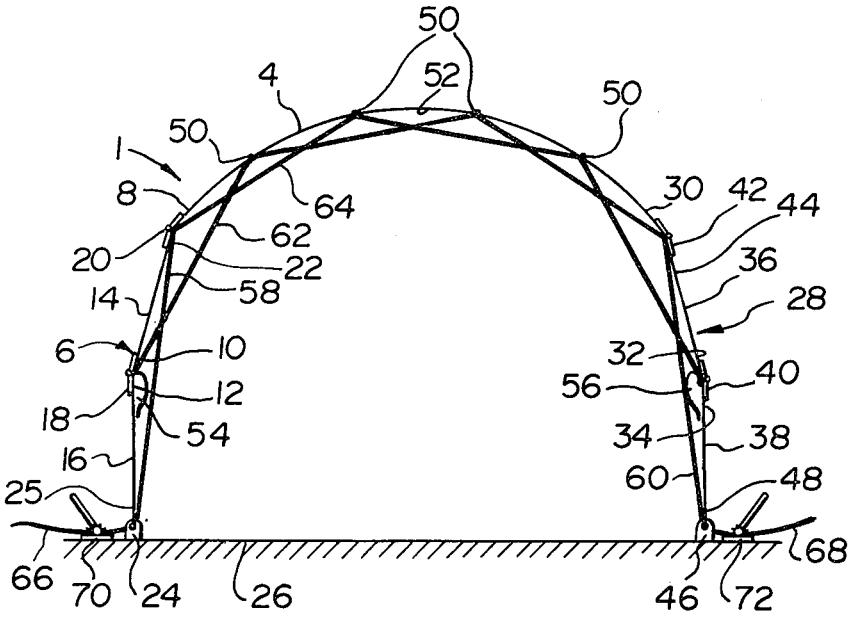
Figure 3:
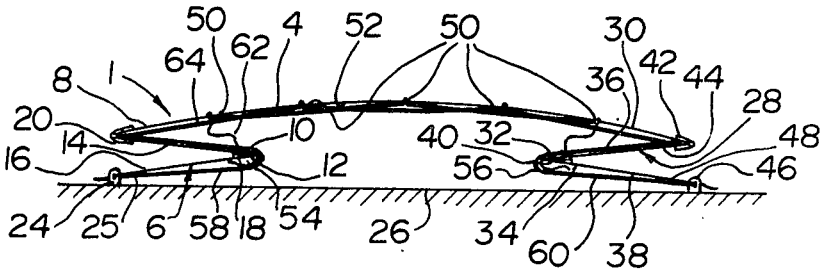
Figure 4:
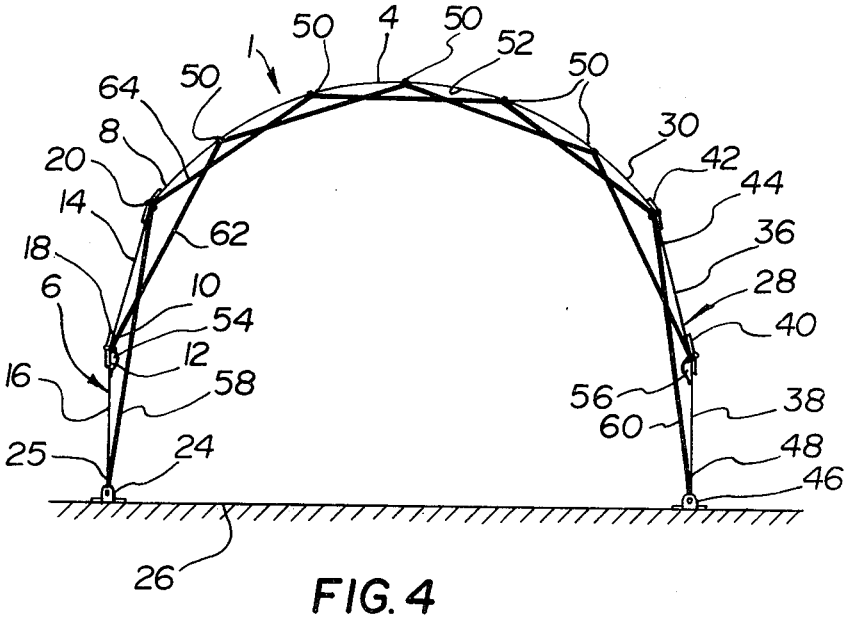
Figure 5:
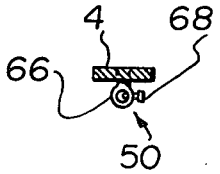

In the accompanying drawings which illustrate, by way of example, embodiments of the present invention, FIG. 1 is a side view of an arch forming structure in the collapsed condition, FIG. 2 is a side view of the arch forming structure shown in FIG. 1, in the erected condition, FIG. 3 is a side view of a different arch forming structure to that shown in FIG. 1, in the collapsed condition, FIG. 4 is a side view of the arch forming structure shown in FIG. 3, in the erected condition, and FIG. 5 is an end view of an eye bolt.

In FIGS. 1 to 4, there is shown two arch forming structures generally designated 1, in FIGS. 1 and 2, and 2 in FIGS. 3 and 4, each, comprising:

(a) a flexible member 4, substantially flat in the collapsed condition (see FIGS. 1 and 3) and for bending therefrom to form, in the erected condition (see FIGS. 2 and 4), the arched portion of the structures 1 and 2, (b) a first pair of hinged strut members generally designated 6, at a first end 8 of the flexible member 4 with two adjacent ends 10, 12 of the strut members, 14, 16 respectively, thereof hinged together, by a hinge 18, and the strut members, 14, 16, when folded together at the hinge 18, in the collapsed condition, shown in FIGS. 1 and 3, extending beneath the flexible member 4 from the first end 8 thereof towards the hinge 18, the hinge 18 allowing limited pivotal movement between the strut members 14, 16 for them to be unfolded and then restrained against further pivotal movement at the erected position through dead center shown in FIGS. 2 and 4, (c) a first connecting hinge 20 pivotally connecting a free end 22 of the first pair of hinged strut members 14, 16 to the first end 8 of the flexible member 4, (d) a first base hinge 24 for pivotally attaching the other free end 25 of the first pair of hinged strut members to a base 26, (e) a second pair of hinged strut members, generally designated 28, at a second end 30 of the flexible member, with two adjacent ends 32, 34 of the strut members, 36, 38, respectively hinged together, by a hinge 40, and the strut members, 35, 38, when folded together at the hinge 40, in collapsed condition shown in FIGS. 1 and 3, extending beneath the flexible member 4 from the second end 30 thereof towards the hinge 40, the hinge 40 allowing limited pivotal movement between the strut members, 36, 38, for them to be unfolded and then restrained against further pivotal movement at the erected position through dead center shown in FIGS. 2 and 4, (f) a second connecting hinge 42 pivotally connecting a free end 44 of the second pair of hinged strut members to the second end 30 of the flexible member 4, (g) a second base hinge 46 for pivotally attaching the other free end 48 of the second pair of hinged strut members to the base 26, (h) a plurality of tension line guides 50 attached to the flexible member 4 at spaced intervals to a side 52 of the flexible member 4 which will define the inside of the arch so that the tension line guides 50 will be spaced therearound as shown in FIGS. 2 and 4, (i) a first tension line deflecting guide 54 attached to the first pair of hinged strut members 6 at a position adjacent the hinge 18 thereof and beneath the strut members thereof when they are folded together in the collapsed condition shown in FIGS. 1 and 3, (j) a second tension line deflecting guide 56 attached to the second pair of hinged strut member 28 at a position adjacent the hinge 40 thereof and beneath the strut members 36, 38 thereof when they are folded together in the collapsed condition shown in FIGS. 1 and 3, and (k) a first tension line length 58 secured by one end to a portion of the first pair of hinged strut members 6 in the region of the first base hinge 24 and extending along the struts, 14, 16, of the first pair of hinged strut members 6 and deflected therefrom, at least in the collapsed condition shown in FIGS. 1 and 3 by the first tension line deflecting member 54, with the other end of the first tension line length 58 secured to a portion of the first pair of hinged strut members 6 in the region of the first connecting hinge 20, (l) a second tension line length 60 secured by one end to a portion of the second pair of hinged strut members 28 in the region of the second base hinge 46 and extending along the strut members 36, 38 of the second pair of hinged strut members 28 and deflected therefrom, at least in the collapsed condition shown in FIGS. 1 and 3 by the second tension line deflecting member 56, with the other end of the second tension line length 60 secured to a portion of the second pair of hinged strut members 28 in the region of the second connecting hinge 42, (m) a third tension line length 62 fastened by one end to the first pair of hinged strut members 6 in the region of the hinge 18 thereof and threaded through odd number tension line guides 50 only, counted from the first pair of hinged strut members 6, and I. when an even number of tension line guides 50 are provided, secured at the other end to the second pair of strut members 28 in the region of the second connecting hinge 42, II. when an odd number of tension line guides 50 are provided, secured at the other end to a portion of the second pair of strut members 28 in the region of the hinge thereof 40, and (n) a fourth tension line length 64 fastened by one end to the first pair of strut members 6 in the region of the first connecting hinge 20 and threaded through even number tension line guides 50 only, counted from the first pair of hinged strut members 6, and III. when an even number of tension line guides 50 are provided, secured at the other end to the second pair of strut members 28 in the region of the hinge 40 thereof, IV. when an odd number of tension line guides 50 are provided, secured at the other end to the second pair of strut members 28 in the region of the second connecting hinge 42, whereby, (o) tensioning of the first and second tension line lengths 58 and 60 respectively, with movement of the first and second pairs of hinged strut members 6 and 28 respectively from the collapsed condition through dead center to the erected condition will cause the third and fourth tension line lengths, 62 and 64 respectively, to bend the flexible member 4 and form the arched portion of the structure.

Referring now to FIG. 5, the tension line lengths may be secured or fastened to their respective members by an eye bolt 66 provided with a set screw 68. When a tension line length is to be secured in a slidable manner, such as, for example, by the tension line guides 50 (FIGS. 1 to 4) the set screw 68 is left untightened until the structure is erected and may then be tightened to provide extra rigidity. When the tension line length is to be fastened, that is secured against slipping, such as, for example, the ends of tension line lengths 62 and 64, the set screw 68 is tightened the whole of the time. Turnbuckles may be provided in at least the tension line lengths 58 and 60 to provide extra rigidity when the structure is in the erected condition.

In some embodiments of the present invention the structure is erected from the collapsed condition by applying a tension to free ends 66 and 68 (FIGS. 1 and 2) of the first and second tension line lengths 58 and 60 respectively by, for example, ratchet actuated winches 70 and 72 respectively. In these embodiments the first and second tension line lengths, 58 and 60 respectively, are fastened against slipping by one end to portions of the first and second pairs of hinged strut members 6 and 28 in the regions of the first and second connecting hinges 20 and 42 respectively. The other ends of the first and second tension line lengths, 58 and 60, respectively are secured in a slidable manner to portions of the first and second pairs of hinged strut members 6 and 28 in the regions of the first and second base hinges 24 and 46 respectively. The free ends 66 and 68 are coiled around the tension line tensioning devices in the form of the ratchet actuated winches 70 and 72 (FIG. 2).

With the structure in the collapsed condition shown in FIG. 1, attaching and actuating the winches 70 and 72 (FIG. 2) will tension the tension line lengths 58 and 60 until the first and second pairs of hinged strut members 6 and 28 are urged through dead center and snap to the positions shown in FIG. 2. This is caused by the tension line lengths 58 and 60 pressing against the tension line deflecting guides 54 and 56 respectively until the first and second pairs of hinged strut members 6 and 28 snap through dead center to the outwardly sloping positions of limited pivotal movement of the hinges 18 and 40 respectively, shown in FIG. 2.

As the first and second pairs of hinged strut members 6 and 28 are opened and snap through dead center the tension line lengths 62 and 64 are tensioned to bend the flexible member 4 from the collapsed condition shown in FIG. 1 to the erected condition shown in FIG. 2.

In some embodiments of the present invention the flexible member 4 is given an initial curve when in the collapsed condition as shown in FIG. 1, to assist the tension line lengths 62 and 64 in initially bending the flexible member 4 in the upward direction to form the arched portion.

In FIGS. 3 and 4, the tension line lengths 58 and 60 are fastened, that is secured against slipping, to the first and second pairs of hinged strut members 6 and 28 respectively in the regions of the first and second base hinges 24 and 46 respectively. The tension line lengths 58 and 60 together with tension line length 64 are length portions of one continuous tension line which is slidably secured to portions of the first and second pairs of hinged strut members 6 and 28 in the regions of their connecting hinges 20 and 42.

In operation, moving the first and second pairs of hinged strut members 6 and 28 from the collapsed condition shown in FIG. 3 to the erected condition shown in FIG. 4 will cause the continuous tension line, composed of tension line lengths 58, 60 and 64, and the tension line length 62 to become tension and bend the flexible member 4 to form the arch shown in FIG. 4.

I claim:

1. An arch forming structure, comprising:

(a) a flexible member, substantially flat in the collapsed condition and for bending therefrom to form, in the erected condition, the arched portion of the structure, (b) a first pair of hinged strut members at a first end of the flexible member with two adjacent ends of the strut members thereof hinged together and the strut members when folded together at the hinge, in the collapsed condition, extending beneath the flexible member from the first end thereof towards the hinge, the hinge allowing limited pivotal movement between the strut members for them to be unfolded and then restrained against further pivotal movement at the erected position through dead center, (c) a first connecting hinge pivotally connecting a free end of the first pair of hinged strut members to the first end of the flexible member, (d) a first base hinge for pivotally attaching the other free end of the first pair of hinged strut members to a base, (e) a second pair of hinged strut members at a second end of the flexible member, with two adjacent ends of the strut members hinged together and the strut members when folded together at the hinge, in the collapsed conditions extending beneath the flexible member from the second end thereof towards the hinge, the hinge allowing limited pivotal movement between the strut members for them to be unfolded and then restrained against further pivotal movement at an erected position through dead center, (f) a second connecting hinge pivotally connecting a free end of the second pair of hinged strut members to the second end of the flexible member, (g) a second base hinge for pivotally attaching the other free end of the second pair of hinged strut members to a base, (h) a plurality of tension line guides attached to the flexible member at spaced intervals to a side of the flexible member which will define the inside of the arch so that the tension line guides will be spaced therearound, (i) a first tension line deflecting guide attached to the first pair of hinged strut members at a position adjacent the hinge thereof and beneath the strut members thereof when they are folded together in the collapsed condition, (j) a second tension line deflecting guide attached to the second pair of hinged strut members at a position adjacent the hinge thereof and beneath the strut members thereof when they are folded together in the collapsed condition, (k) a first tension line length secured by one end to a portion of the first pair of hinged strut members in the region of the first base hinge and extending along the struts of the first pair of hinged strut members and deflected therefrom by the first tension line deflecting member, with the other end of the first tension line length secured to a portion of the first pair of hinged strut members in the region of the first connecting hinge, (l) a second tension line length secured by one end to a portion of the second pair of hinged strut members in the region of the second base hinge and extending along the strut members of the second pair of hinged strut members and deflected therefrom by the second tension line deflecting member, with the other end of the second tension line length secured to a portion of the second pair of hinged strut members in the region of the second connecting hinge, (m) a third tension line length fastened by one end to the first pair of hinged strut members in the region of the hinge thereof and threaded through odd number tension line guides only, counted from the first pair of hinged strut members, and I. when an even number of tension line guides are provided, secured at the other end to the second pair of strut members in the region of the second connecting hinge, II. when an odd number of tension line guides are provided, secured at the other end to a portion of the second pair of strut members in the region of the hinge thereof, and (n) a fourth tension line length fastened by one end to the first pair of strut members in the region of the first connecting hinge and threaded through even number tension line guides only, counted from the first pair of hinged strut members, and III. when an even number of tension line guides are provided, secured at the other end to the second pair of strut members in the region of the hinge thereof, IV. when an odd number of tension line guides are provided, secured at the other end to the second pair of strut members in the region of the second connecting hinge, whereby, (o) tensioning of the first and second tension line lengths with movement of the first and second pairs of hinged struts from the collapsed condition through dead center to the erected condition will cause the third and fourth tension line lengths to bend the flexible member and form the arched portion of the structure.

2. A structure according to claim 1, which includes tension line tension devices for the first and second tension line lengths, and wherein the first and second tension line lengths are slidably secured to the portions of the first and second pairs of hinged strut members respectively, in the regions of the first and second base hinges respectively, with their ends connected to the tension line tensioning devices for being tensioned thereby.

3. A structure according to claim 1, wherein the first and second tension line lengths are each secured against slipping at each end to the said portions of the first and second pairs of hinged members.

4. A structure according to claim 1, wherein the flexible member is given an initial curve in the collapsed condition to assist in bending the flexible member to form the arched portion in the erected condition.

* * * * *